US008834647B2

(12) United States Patent
Gnadinger et al.

(10) Patent No.: US 8,834,647 B2
(45) Date of Patent: Sep. 16, 2014

(54) MANUAL REMOVABLE FILTER SYSTEM FOR A DISHWASHER

(75) Inventors: Errin Whitney Gnadinger, Louisville, KY (US); Kyle Durham, Louisville, KY (US)

(73) Assignee: General Electric Company, Schenectady, NY (US)

( * ) Notice: Subject to any disclaimer, the term of this patent is extended or adjusted under 35 U.S.C. 154(b) by 369 days.

(21) Appl. No.: 13/198,774

(22) Filed: Aug. 5, 2011

(65) Prior Publication Data

US 2013/0032178 A1 Feb. 7, 2013

(51) Int. Cl.
*B08B 3/00* (2006.01)
*A47L 15/42* (2006.01)

(52) U.S. Cl.
CPC ..... *A47L 15/4206* (2013.01)
USPC ..... 134/56 D; 134/57 D

(58) Field of Classification Search
None
See application file for complete search history.

(56) References Cited

U.S. PATENT DOCUMENTS 5,433,231 A 7/1995 Weaver
7,431,774 B2 10/2008 Kim
2004/0007253 A1* 1/2004 Jung et al. ..... 134/10

FOREIGN PATENT DOCUMENTS

EP 2087830 B1 1/2010

* cited by examiner

*Primary Examiner* — Jason Ko
(74) *Attorney, Agent, or Firm* — Douglas D. Zhang; Global Patent Operation

(57) ABSTRACT

A removable multi-stage filter assembly for a dishwasher system is provided, comprising: a plurality of concentric filter stages having a varying degree of filter granularity; and a closed bottom that retains soils for manual collection by an end user, wherein the closed bottom has at least one drain opening. A dishwasher system is also provided that comprises a tub; a fluid circulation system for circulating water in the tub; and a removable multi-stage filter assembly, wherein the removable filter assembly comprises a closed bottom and at least one drain opening, and wherein the removable multi-stage filter assembly retains soils for manual collection by an end user.

9 Claims, 6 Drawing Sheets

MANUAL REMOVABLE FILTER SYSTEM FOR A DISHWASHER

BACKGROUND OF THE INVENTION

The present disclosure relates generally to dishwashers and, more particularly, to techniques for filtering water in dishwashers. A dishwasher is a mechanical device for cleaning dishes, utensils and other items. Various types of dishwashers are known and are currently available. Spray dishwashers, for example, spray warm water and detergent within a dishwasher cabinet to wash the items arranged in racks.

Conventional dishwasher systems include a main pump assembly and a drain pump assembly for circulating and draining wash fluid, respectively, within a wash chamber defined within the dishwasher system. The main pump assembly feeds wash fluid to various spray arm assemblies for distribution throughout the wash chamber to wash soiled items loaded into dishwasher racks positioned within the wash chamber. Wash fluid sprayed onto the dishwasher items is collected in a sump located in a lower portion of the wash chamber, and water entering the sump is filtered through one or more coarse filters to remove soil and/or sediment from the wash fluid.

At least some conventional dishwasher systems further include a filter system in flow communication with the main pump assembly to remove soil and/or sediment of a smaller particle size than those particles filtered by the coarse filters. The main pump assembly draws wash fluid from the sump to re-circulate in the wash chamber, and the coarse and fine filters are used to continuously filter the water in the sump during the re-circulation process.

While existing filter systems effectively remove soil and/or sediment from the recirculated water, they suffer from a number of limitations, which if overcome, could further extend the utility and effectiveness of such filter systems. For example, existing filter systems typically have open bottoms, thus leaving soils behind when the filter is removed. A need therefore exists for improved techniques for filtering water in dishwashers.

BRIEF DESCRIPTION OF THE INVENTION

As described herein, the exemplary embodiments of the present invention overcome one or more disadvantages known in the art. Generally, water fill level detection techniques are provided for a dishwasher system.

According to one aspect of the invention, a removable multi-stage filter assembly for a dishwasher system is provided, comprising: a plurality of concentric filter stages having a varying degree of filter granularity; and a closed bottom that retains soils for manual collection by an end user, wherein the closed bottom has at least one drain opening.

According to another aspect of the invention, a dishwasher system is provided that comprises a tub; a fluid circulation system for circulating water in the tub; and a removable multi-stage filter assembly, wherein the removable filter assembly comprises a closed bottom with one or more drain openings, and wherein the removable multi-stage filter assembly retains soils for manual collection by an end user.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

The present invention provides a manually removable filter system for a dishwasher. According to one aspect of the invention, the disclosed filter system can be manually removed and cleaned by the user. As discussed hereinafter, the filter assembly captures soils from washing during the wash cycle. A portion of the captured soils are drained out through a collection chamber and into a drain pump and the residual soils are left inside of the filter to be cleaned by the user.

According to another aspect of the invention, the disclosed filter assembly is comprised of a knob assembly and a filter hub integrated in one piece, and an overmolded dual screen filter assembly. The exemplary dual screen filter assembly comprises two screens of different filter hole sizes (i.e., granularity) and is removable from the knob assembly using a twist-lock or snap-action feature, such that the user can remove the dual screen filter assembly from the knob assembly for cleaning, if necessary. The filter assembly is constructed such that both screens are an integral part of the filter assembly, and thus come out as part of the entire filter assembly when removed. In this manner, the user can remove the dual screen filter system in a single action, such that the user need not to reach down a second time to remove a second filter after the main manual filter assembly is removed.

According to yet another aspect of the invention, the filter assembly employs a collection chamber beneath the filter bottom. As discussed further below in conjunction with FIG. 6, the bottom of the filter assembly includes drain openings, for example, in the form of slots. The drain openings allow soils to drain into the collection chamber. The bottom of the filter assembly also includes lock tabs that are engaged to retain the filter assembly in place.

Another aspect of the disclosed filter assembly employs a closed bottom design in which a bulk of residual soil is brought with the filter assembly upon removal, as opposed to conventional open bottom designs that leave food soils behind in the central filter area.

Figure 1:
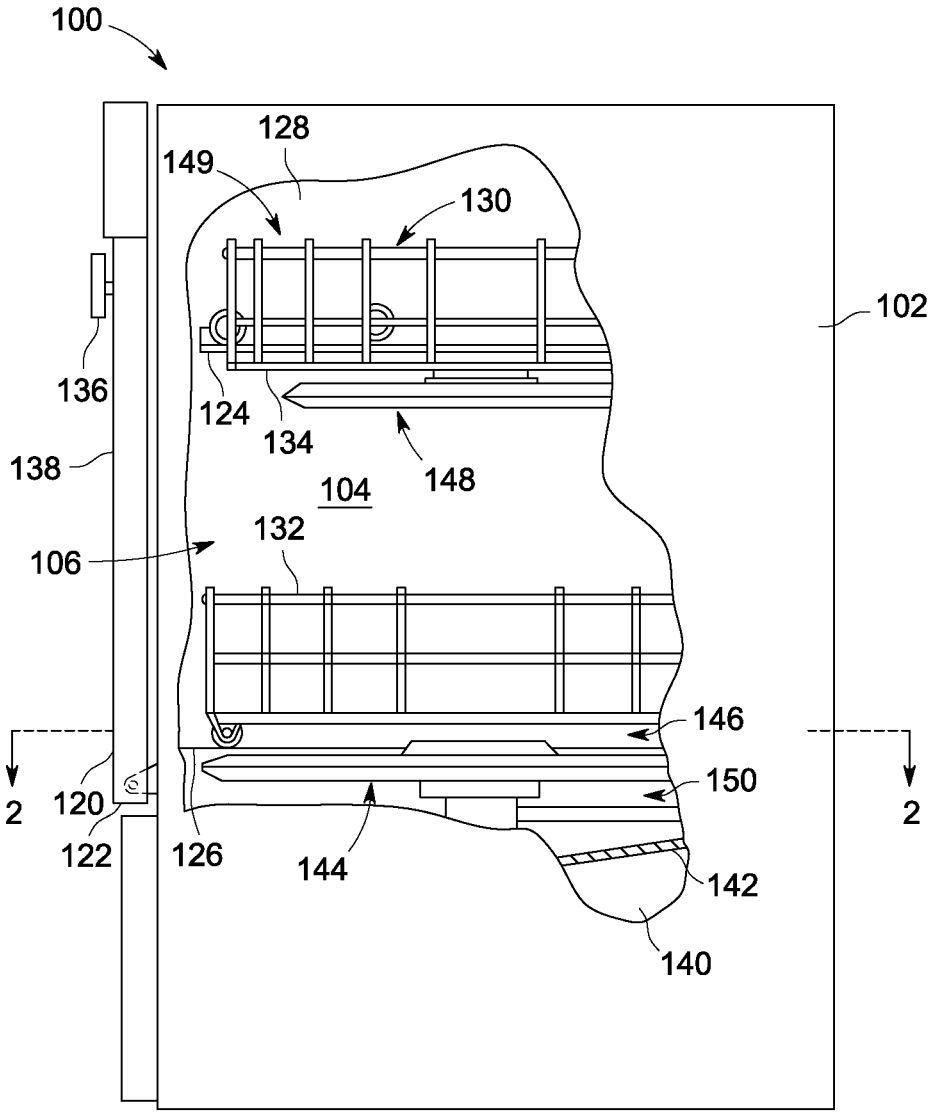
FIG. 1 is a side elevation view of an exemplary domestic dishwasher system partially broken away, and in which the present invention may be implemented.

FIG. 1 is a side elevation view of an exemplary dishwasher system 100 with a portion of a cabinet sidewall removed. It should be apparent to those skilled in the art and guided by the teachings herein provided that the wash fluid distribution and filtration assembly described herein may be suitable for incorporation with other types of dishwashers and dishwasher systems. Accordingly, the following description is for illustrative purposes only and in no way limits use of the described assemblies and methods to a particular type of dishwasher system.

Dishwasher system 100 includes a cabinet 102 having a tub 104 forming a wash chamber 106. Tub 104 includes a front opening (not shown in FIG. 1) and a door 120 hinged at a bottom portion 122 for movement between a closed position (shown in FIG. 1) wherein door 120 seals the wash chamber 106 for washing operation, and an open position (not shown) for loading and unloading of dishwasher contents. Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which the rack is substantially positioned outside wash chamber 106, and a retracted position (shown in FIG. 1) in which the rack is located inside wash chamber 106. A silverware basket (not shown) is removably attached to lower rack 132 for placement of silverware, utensils and the like that are too small to be accommodated by upper and lower racks 130, 132.

A control input selector 136 is mounted at a convenient location on an outer face 138 of door 120 and is operatively coupled to known control circuitry (not shown) and control mechanisms (not shown) for operating a fluid distribution assembly for circulating water and dishwasher fluid in dishwasher tub 104. The fluid distribution assembly, as described below, is located in a machinery compartment 140 located below a bottom sump portion 142 of tub 104.

A lower spray arm assembly 144 is rotatably mounted within a lower region 146 of wash chamber 106 and above tub sump portion 142 such that lower spray arm assembly 144 rotates in relatively close proximity to lower rack 132. A mid-level spray arm assembly 148 is located in an upper region 149 of wash chamber 106 and is positioned in close proximity to upper rack 130 at a sufficient height above lower rack 132 such that lower rack 132 accommodates larger items, such as a dish, pot and/or platter (not shown). In a further embodiment, an upper spray arm assembly (not shown) is located above upper rack 130.

Lower spray arm assembly 144 and mid-level spray arm assembly 148 are fed by a fluid distribution assembly 150. Each spray arm assembly 144, 148 includes an arrangement of discharge ports or orifices for directing wash fluid onto dishes located in lower rack 132 and upper rack 130, respectively. The arrangement of the discharge ports in at least lower spray arm assembly 144 provides a rotational force as wash fluid is directed to flow through the discharge ports. The resultant rotation of lower spray arm assembly 144 distributes wash fluid to cover dishes and other contents with a washing spray. In alternative embodiments, mid-level spray arm assembly 148 and/or the upper spray arm are also rotatably mounted and configured to generate a swirling spray pattern above and/or below upper rack 130 when fluid distribution assembly 150 is activated.

Figure 2:
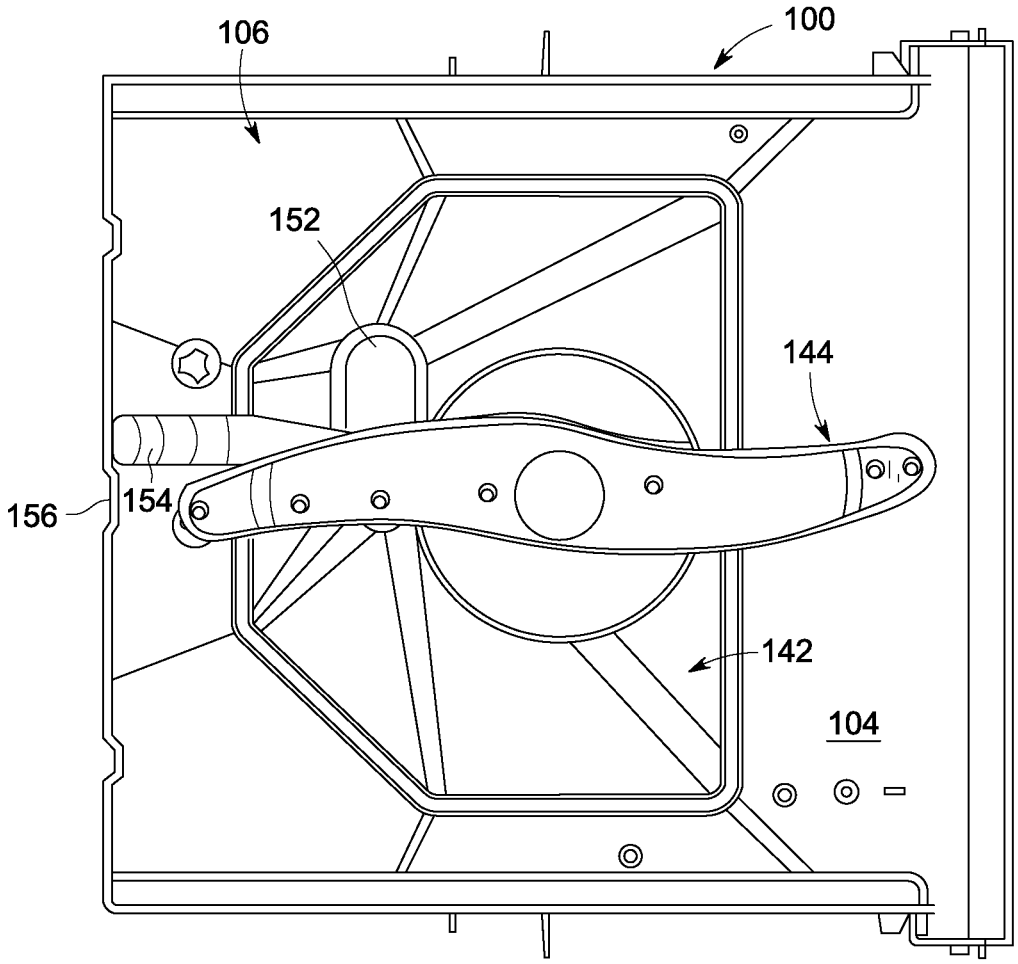
FIG. 2 is a top plan view of the dishwasher system of FIG. 1 along line 2-2.

FIG. 2 is a top plan view of dishwasher system 100 along sectional line 2-2 shown in FIG. 1 above lower spray arm assembly 144. Lower spray arm assembly 144 is substantially horizontally centered within tub 104 and wash chamber 106 and positioned above tub 104 and tub sump portion 142 to facilitate free rotation of lower spray arm assembly 144.

Tub 104 and tub sump portion 142 are downwardly sloped toward sump assembly 152 so that water sprayed from lower spray arm assembly 144, mid-level spray arm assembly 148 and the upper spray arm assembly is collected in tub sump portion 142 and directed toward sump assembly 152 for filtering and re-circulation, as described below, during an exemplary dishwasher system wash cycle. In addition, a conduit 154 extends beneath lower spray arm assembly 144 and is in flow communication with fluid distribution assembly 150 (FIG. 1). Conduit 154 extends to a back wall 156 of wash chamber 106, and upward along back wall 156 for feeding wash fluid to mid-level spray arm assembly 148 (FIG. 1) and/or the upper spray arm assembly.

Figure 3:
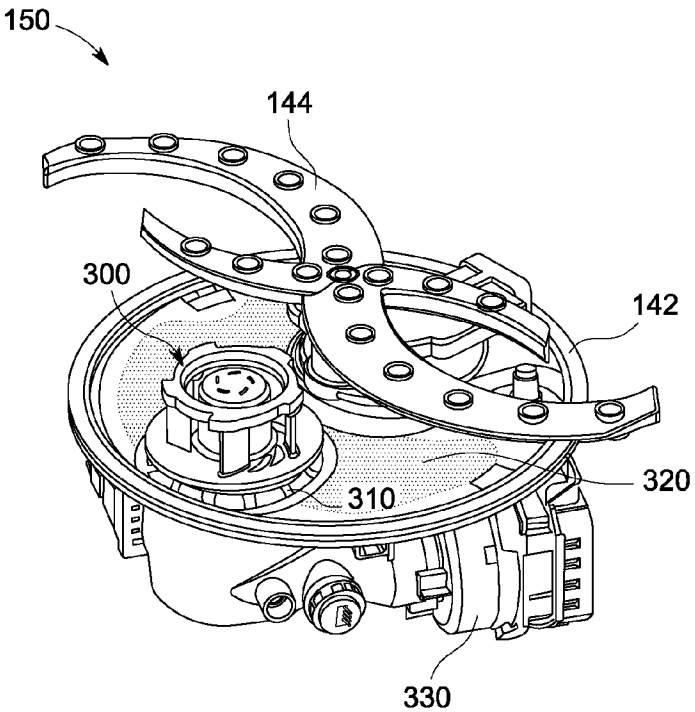
FIG. 3 is a top perspective view of the fluid distribution assembly and lower spray arm assembly of FIG. 1.

FIG. 3 is a top perspective view of the fluid distribution assembly 150 and lower spray arm assembly 144 of FIG. 1. As shown in FIG. 3, the exemplary bottom sump portion 142 of tub 104 (FIG. 1) contains a coarse filter 320 for removing larger soils. In addition, a manual filter assembly 300, incorporating features of the present invention, extends through the bottom sump portion 142 using a filter adapter 310 that engages the manual filter assembly 300 to help retain it in place. The manual filter assembly 300 is discussed further below, for example, in conjunction with FIGS. 5-7. The flow of water through the manual filter assembly 300 and wash pump 330 during a wash cycle is discussed further below in conjunction with FIG. 8. Generally, the wash pump 330 draws wash fluid from the sump 142 through the manual filter assembly 300 to re-circulate wash fluid in the wash chamber 106 (FIG. 1). As discussed further below, the manual filter assembly 300 contains coarse and fine filters to continuously filter the water in the sump during the re-circulation process.

Figure 4:
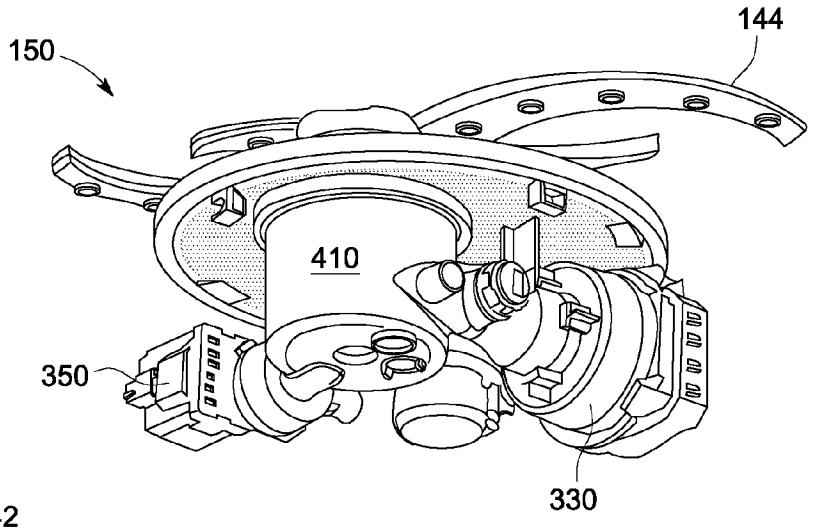
FIG. 4 is a bottom perspective view of the fluid distribution assembly and lower spray arm assembly of FIGS. 1 and 3.

FIG. 4 is a bottom perspective view of the fluid distribution assembly 150 and lower spray arm assembly 144 of FIGS. 1 and 3. The lower portion of the manual filter assembly 300 is positioned within a sump manifold 410, shown in FIG. 4. The manual filter assembly 300 extends through the bottom sump portion 142. FIG. 4 illustrates the relationship between the wash pump 330, the drain pump 350 and the sump manifold 410 (containing a portion of the manual filter assembly 300). The flow of water through the manual filter assembly 300 and the drain pump 350 during a drain cycle is discussed further below in conjunction with FIG. 9. Generally, the drain pump 350 draws wash fluid from the sump 142 (FIG. 3) through the manual filter assembly 300 and out through a drain (not shown), to withdraw water from the wash chamber 106 (FIG. 1).

Figure 5:
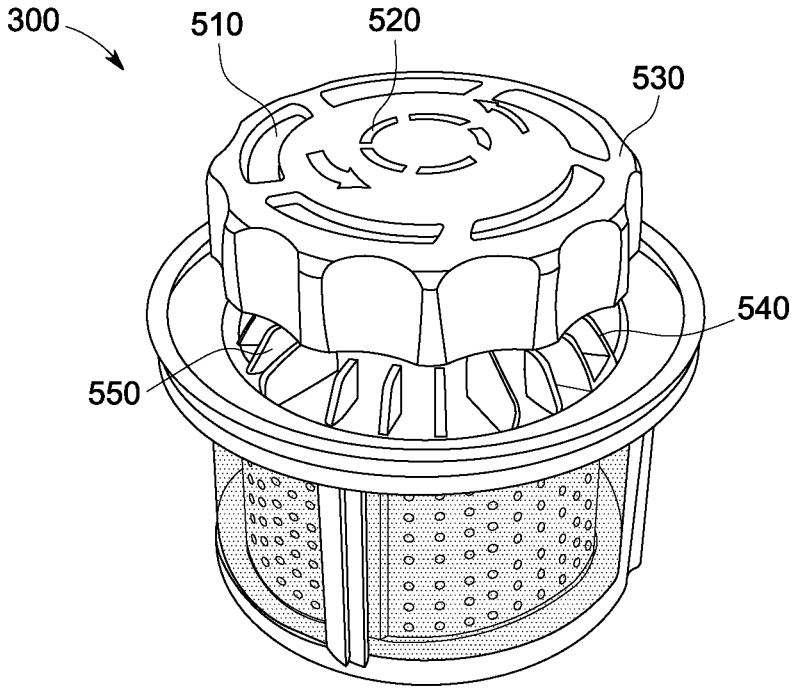
FIG. 5 is a top perspective view of the manual filter assembly of FIG. 3 in further detail.

FIG. 5 is a top perspective view of the manual filter assembly 300 of FIG. 3 in further detail. As shown in FIG. 5, the manual filter assembly 300 comprises a set of back flush holes 510 for manual cleaning, vent holes 520 and a hand knob 530 that allows a user to rotate and remove the manual filter assembly 300. The back flush holes 510 allow sediment and other soils to be removed from the manual filter assembly 300 using a reverse flow of water or another fluid. In addition, the manual filter assembly 300 includes fins 540 and openings 550 between the fins 540, in a circular arrangement around the perimeter of the manual filter assembly 300 as part of an inlet filter (often referred to as a bearclaw inlet filter).

Figure 6:
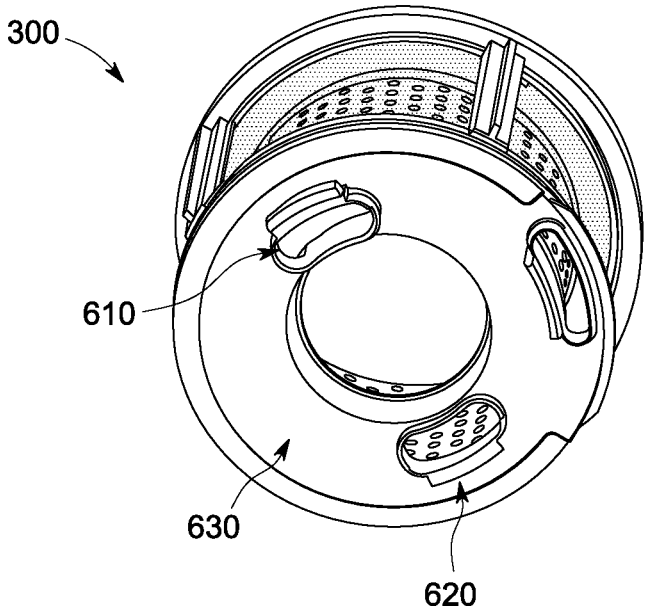
FIG. 6 is a bottom perspective view of the manual filter assembly of FIG. 5 in further detail.

FIG. 6 is a bottom perspective view of the manual filter assembly 300 of FIG. 5 in further detail. As shown in FIG. 6, according to one aspect of the invention, the manual filter assembly 300 comprises a closed bottom 630 which spans the space between the hub receiving central opening and the perimeter of the filter assembly to catch and retain large soils. Bottom 630 has formed therein drain openings in the form of slots 610. The exemplary drain openings 610 allow soils to drain to the collection chamber (not shown) below the bottom 630 and the sump 142 (FIG. 3). The lock tabs 620 projecting from bottom 630 engage with the floor plate of the sump 142 (FIG. 2) to retain the manual filter assembly 300 in place.

Figure 7:
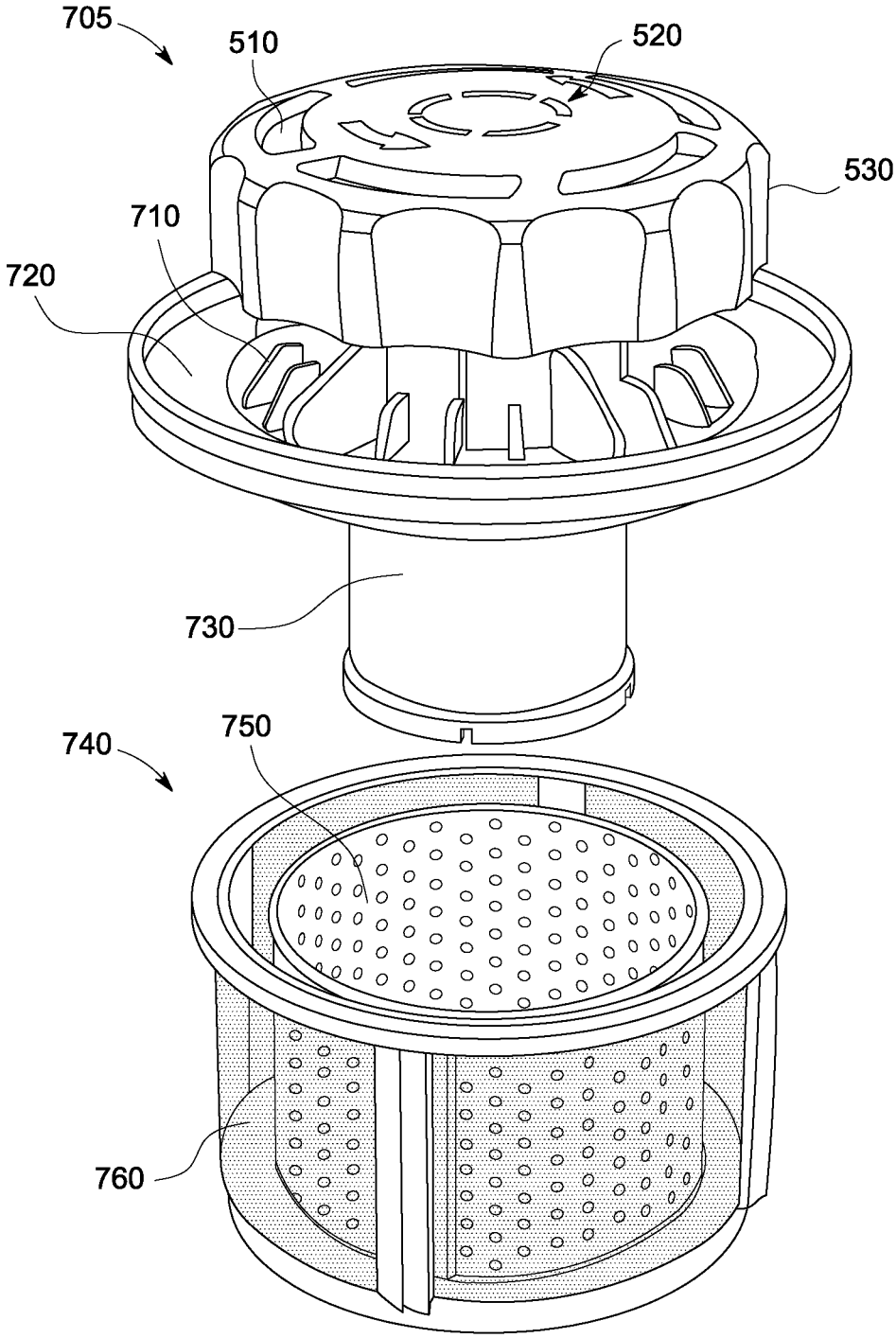
FIG. 7 is a partially exploded view of the manual filter assembly illustrating the filter knob assembly separated from the dual filter assembly.

FIG. 7 is a partially exploded view of the manual filter assembly 300 illustrating the filter knob assembly 705 separated from the dual filter assembly 740. In one embodiment, the filter knob assembly 705 is releasably coupled to the dual filter assembly 740 using a twist lock mechanism.

As discussed above in conjunction with FIG. 5, the filter knob assembly 705 comprises a set of back flush holes 510 for manual cleaning, vent holes 520 and a hand knob 530 that allows a user to rotate and remove the manual filter assembly 300 from the fluid distribution assembly 150 (FIG. 1). In addition, as shown in FIG. 7, the filter knob assembly 705 comprises a stage 1 filter 710, a large soil catch tray 720 and a filter hub 730. The exemplary stage 1 filter 710 is comprised of the fins 540 and openings 550 between the fins 540, as discussed above in conjunction with FIG. 5, in a circular arrangement around the perimeter of the large soil catch tray 720. In one exemplary embodiment, the filter hub 730 is hollow.

As shown in FIG. 7, the dual filter assembly 740 comprises a stage 2 filter 750 and a stage 3 filter 760. In one exemplary embodiment, the stage 2 filter 750 and stage 3 filter 760 are concentric and overmolded to a cage. The overmolded dual screen filter assembly can optionally be removed from the knob assembly using one or more of a twist-lock feature and a snap-action feature for cleaning.

Generally, the stage 2 filter 750 is more coarse (larger holes) than the stage 3 filter 760. The water flow enters the interior region between the hub and the cylindrical screen of filter 750 and flows radially out through the stage 2 filter 750 and then the stage 3 filter 760. For example, an exemplary stage 2 filter 750 can be embodied as a 0.060" diameter stainless steel filter and an exemplary stage 3 filter 760 can be embodied as a 0.010"-0.020" diameter stainless steel mesh filter.

Figure 8:
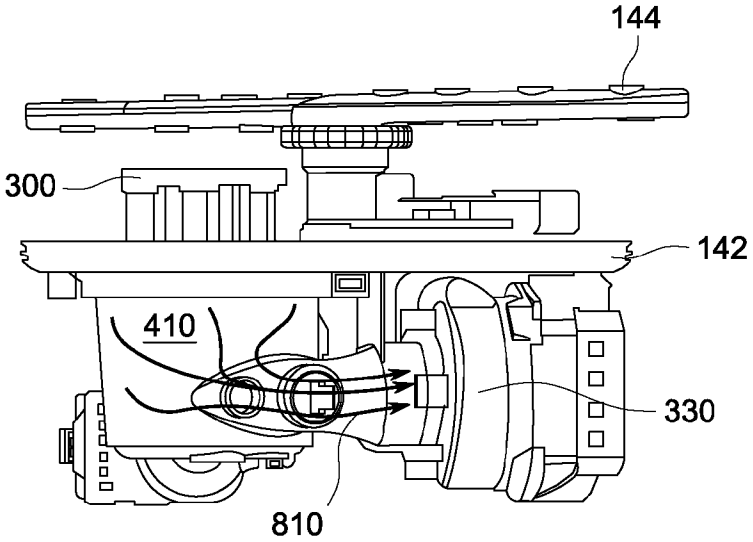
FIG. 8 illustrates the flow of water through the manual filter assembly and wash pump of FIGS. 3 and 4 during a wash cycle.

FIG. 8 illustrates the flow of water 810 through the manual filter assembly 300 and wash pump 330 during a wash cycle. Generally, as shown in FIG. 8, the wash pump 330 draws wash fluid from the sump 142 through the manual filter assembly 300 and into the sump manifold 410 to re-circulate water in the wash chamber 106 (FIG. 1).

Figure 9:
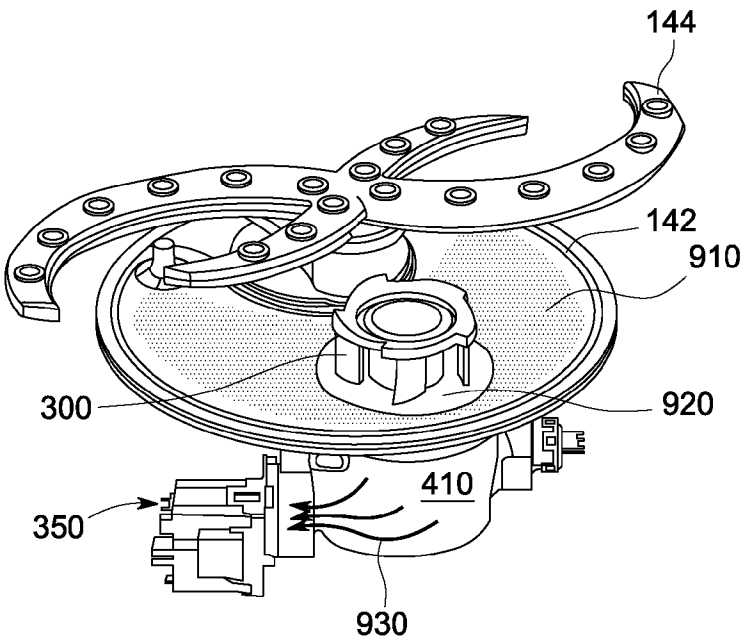
FIG. 9 illustrates the flow of water through the manual filter assembly and the drain pump of FIGS. 3 and 4 during a drain cycle.

FIG. 9 illustrates the flow 930 of water through the manual filter assembly 300 and the drain pump 350 during a drain cycle. Generally, the drain pump 350 draws wash fluid from the sump 142 through the manual filter assembly 300, into the sump manifold 410 and out through a drain (not shown), to withdraw water from the wash chamber 106 (FIG. 1).

In addition, as shown in FIG. 9, the exemplary sump 142 comprises a coarse filter 910, such as a 0.060" diameter stainless steel filter, and a soil collection tray 920, such as ⅝" openings.

As should be apparent, the flow 1020 of water through the manual filter assembly 300 during a wash cycle. The water enters the manual filter assembly 300 through openings 550 between the fins 540 (FIG. 5), and flows down the center of the manual filter assembly 300 and then radially out through stage 2 filter 750 (FIG. 7) and stage 3 filter 760 (FIG. 7) of the dual filter assembly 740.

In addition, a floor plate 1030 forms the closed bottom 630 of FIG. 6. The collection chamber collects soils to be pumped out during the drain cycle (FIG. 9) into a drain pump. Any soils left inside of the filter as residual soil can be cleaned by the user, in accordance with the present invention.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components, or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A removable multi-stage filter assembly for a dishwasher system, comprising:

a plurality of concentric filter stages having a varying degree of filter granularity; and a closed bottom that retains soils for manual collection by a user, wherein said closed bottom has at least one drain opening, wherein said plurality of concentric filter stages are embodied as an overmolded filter assembly wherein each of said plurality of concentric filter stages is integrally attached to said overmolded filter assembly such that said overmolded filter assembly is a single piece.

2. The removable multi-stage filter assembly of claim 1, wherein said plurality of concentric filter stages comprise an integrated assembly that can be removed by a user.

3. The removable multi-stage filter assembly of claim 1, further comprising a knob assembly and wherein said overmolded filter assembly is releasably coupled to said knob assembly using one or more of a twist-lock feature and a snap-action feature for cleaning.

4. The removable multi-stage filter assembly of claim 1, further comprising a knob assembly and wherein a user can remove said overmolded filter assembly from said knob assembly for cleaning.

5. The removable multi-stage filter assembly of claim 1, further comprising an integrated knob assembly and a filter hub.

6. The removable multi-stage filter assembly of claim 1, wherein each of said plurality of concentric filter stages has a different degree of filter granularity.

7. The removable multi-stage filter assembly of claim 4, wherein said knob assembly comprises one or more back flush holes, one or more vent holes, and a hand knob.

8. The removable multi-stage filter assembly of claim 7, wherein said knob assembly further comprises an inlet filter, a soil catch tray and a filter hub.

9. The removable multi-stage filter assembly of claim 8, wherein said inlet filter of said knob assembly comprises one or more fins and openings between said one or more fins, said one or more fins and openings being in a circular arrangement around a perimeter of said soil catch tray.

* * * * *